US010032350B2

(12) United States Patent
Riekie

(10) Patent No.: US 10,032,350 B2
(45) Date of Patent: Jul. 24, 2018

(54) SYSTEM AND METHOD FOR MONITORING AN AREA

(71) Applicant: Leslie Riekie, Umm Suqeim (AE)

(72) Inventor: Leslie Riekie, Umm Suqeim (AE)

( * ) Notice: Subject to any disclaimer, the term of this patent is extended or adjusted under 35 U.S.C. 154(b) by 0 days.

(21) Appl. No.: 13/705,193

(22) Filed: Dec. 5, 2012

(65) Prior Publication Data

US 2014/0150708 A1 Jun. 5, 2014

(51) Int. Cl.
*G08B 15/02* (2006.01)

(52) U.S. Cl.
CPC ..... *G08B 15/02* (2013.01)

(58) Field of Classification Search
CPC .... G08B 15/00; G08B 15/001; G08B 15/002; G08B 15/02; G08B 13/10
USPC ..... 116/98, 75, 82, 200, 201
See application file for complete search history.

(56) References Cited

U.S. PATENT DOCUMENTS 3,741,137 A * 6/1973 Eisenhardt ..... A01C 23/02 111/118
3,970,012 A * 7/1976 Jones, Sr. ..... A01B 21/04 111/118
4,586,444 A * 5/1986 Thiessen ..... A01C 23/02 111/122
2010/0022023 A1* 1/2010 Cranor et al. ..... 436/172
2011/0135888 A1* 6/2011 Xu et al. ..... 428/195.1

FOREIGN PATENT DOCUMENTS

DE 3905833 A1 * 8/1990 ..... G08B 15/02
GB 2057003 A * 3/1981 ..... G08B 15/02
JP 11195179 A * 7/1999 ..... G08B 15/00
JP 2004199246 A * 7/2004 ..... G08B 15/00
JP 2011006871 A * 1/2011 ..... G08B 15/00
WO WO 2010122159 A1 * 10/2010 ..... C12Q 1/68

* cited by examiner

*Primary Examiner* — R. A. Smith
(74) *Attorney, Agent, or Firm* — Spradley PLLC; Michael Spradley

(57) ABSTRACT

A system for monitoring an area is disclosed herein. Specifically, a chemical-based system is disclosed. The system can comprise a chemical, chemical compound or chemical mixture. The system can, in one embodiment, permanently crush and/or flatten upon contact with no ability to be repaired or concealed after contact with a disturbance by an intruding force. The disturbance to chemical leaves behind impressions, which can be used to determine characteristics about intruding forces.

19 Claims, 11 Drawing Sheets

SYSTEM AND METHOD FOR MONITORING AN AREA

BACKGROUND

This disclosure relates to a chemical-based system and method for the monitoring an area.

For purposes of this disclosure, methods for monitoring an area are discussed. However, such discussion of methods for monitoring an area is solely exemplary, and not limiting.

Methods for monitoring an area have evolved over the years. Regardless of geography, nature of activity, or types of facilities used in day-to-day life, security and crime detection are fundamental concerns throughout the world for people in all contexts. Over the years, surveillance, law-enforcement, and military resources have evolved to protect society from crimes ranging from simple mischief, to even greater atrocities, such as murder and terrorism.

Various methods exist for the detection of intrusion. Nevertheless, rates of crime and acts of terrorism still pose threats. Conventional methods not only fall short of achieving security, but also bear heavy costs to society for optimal implementation. Passive methods of detection, such as cameras and fences, fall short of deterring determined intruders. Active methods of detection, such as patrolling personnel, are costly for society and pose high-risks for the personnel themselves. Furthermore, threats to security are also on the rise on both large and small scales. Despite the global effort to combat terrorism, roadside improvised explosive devices (IEDs) are a looming threat to the lives of soldiers and contractors, as well as local populations, in war-torn areas.

Where the prevention of crime is impossible, deterrence of future crimes for an affected site could be improved by better detection capabilities and investigation techniques after breach. Current post-crime detection methods, such as footprint analysis, not only bear high cost burdens for expert analysis, but may also prove inaccurate and capable of evasion. Specifically, soil sampling techniques can be expensive and still yield significant margins of error. When covert detection tactics are necessary to optimize security, certain alarm systems can be inflexible and may result in only an overt detection of intruders. Also the uncertainty of some types of threats, as well as the lack of knowledge about a given area, often results in inefficiency. Specifically, a heavily disproportionate amount of resources may be allocated to patrol a relatively secure military asset, while a vulnerable asset might be neglected.

Thus, it would be useful to have an improved system and method for monitoring an area.

SUMMARY

A system for monitoring an area is disclosed herein. Specifically, a chemical-based system is disclosed. The system can comprise a chemical, chemical compound or chemical mixture. The system can, in one embodiment, permanently crush and/or flatten upon contact with no ability to be repaired or concealed after contact with a disturbance by an intruding force. The disturbance to chemical leaves behind impressions, which can be used to determine characteristics about intruding forces.

The chemical can be applied to a variety of terrains and other surfaces. Additives can be applied to the chemical for a variety of purposes, including, but not limited to, supporting the durability of the system or aiding its application to a surface. The system can also, in one embodiment, stain or mark any intruding person, animal or object that comes into contact with the chemical, chemical compound or chemical mixture.

Additionally, a method for detecting intruders is disclosed. The method can comprise applying a chemical, chemical compound or chemical mixture to a terrain or other surface. Disturbances of intruding forces are observed by impressions left behind in chemical. The traces of chemical left behind on intruding force can either be obvious or concealed. Intruding force can be checked for the presence of chemical and/or compared with impressions in the monitoring area. Additives can be applied to chemical to enhance the linking of a chemical trace or impression with an intruding force. Furthermore, this method can be used in conjunction with conventional surveillance techniques.

DETAILED DESCRIPTION

Described herein is a system and method for monitoring an area. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
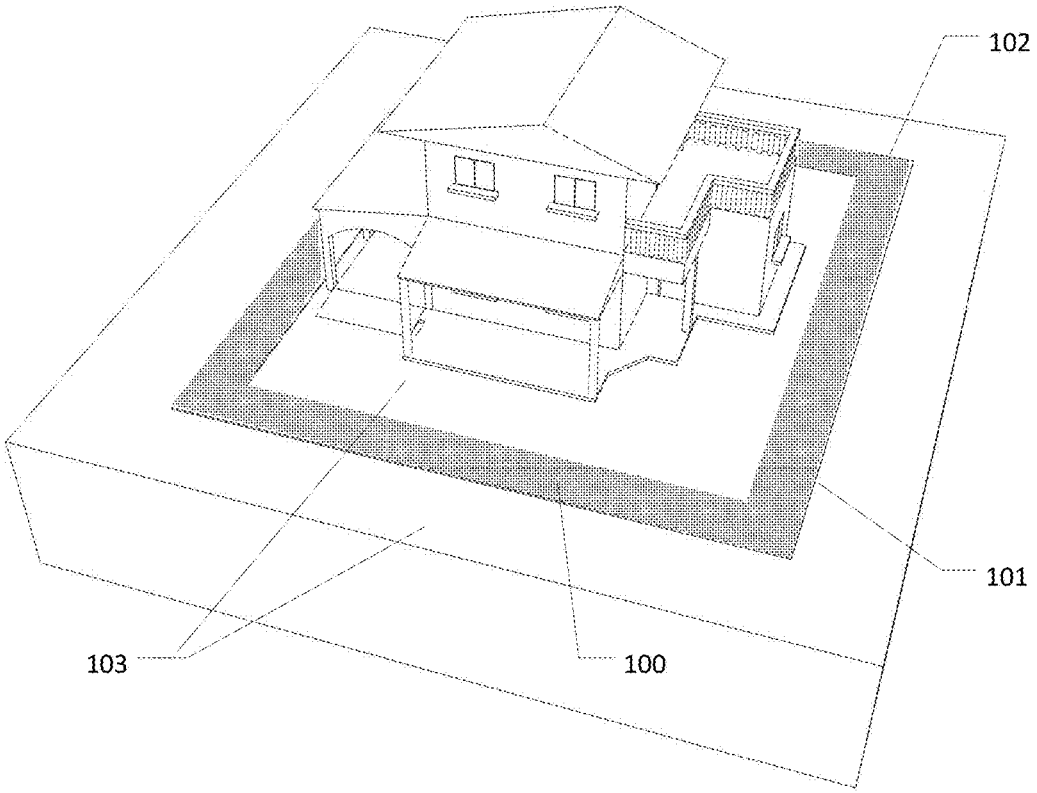
FIG. 1 illustrates a chemical applied to a terrain.

FIG. 1 illustrates a chemical 100 applied to a terrain 103. For the purposes of this disclosure, "chemical" can also mean a chemical compound or a mixture of chemicals and/or chemical compounds. The spatial dimensions of chemical 100 applied to terrain 103 establish a monitored area 101. In FIG. 1, monitored area 101 is shown without any disturbances. For the purposes of this disclosure, a disturbance can mean any contact with chemical 100 made by any intruding force, which physically alters the surface of chemical 100. Furthermore, an intruding force can be defined as any person, animal or thing, which makes physical contact with the monitored area 101. In one embodiment, chemical 100 can comprise a liquid polyvinyl acetate emulsion.

In one embodiment, monitored area 101 can surround a structure, such as a building. Chemical 100, in one embodiment, can be shaped to create a boundary 102 between monitored area 101 and terrain 103. The width of monitored area 101 may be adjusted as needed to prevent evasion by potential intruding entities. In one embodiment, chemical 100 can be applied by spraying it on to any surface or terrain 103 with a spray applicator.

In one embodiment, chemical 100 may comprise dye, which overtly marks monitored area 101 in a visible color. In another embodiment, chemical 100 may be transparent to visibly conceal monitored area 101 and allow chemical 100 to be camouflaged with surrounding surface of terrain 103. In one embodiment, glossers can also be applied to chemical 100 for a surface finish to add visibility to the monitored area 101 and easily indicate any presence of disturbance to the surface of chemical 100. In another embodiment, color dyes can be made to have the ability to fade automatically over time or fade in response to climate. The use of different colors and fades can be used to note cleared areas of monitored area 101.

In another embodiment, chemical 100 may appear visible with the application of ultraviolet radiation technology. For instance, chemical 100 can change appearance when placed under a black light. In one embodiment, photosensitive properties can be applied to chemical 100 in which the monitored area 101 fluoresces or darkens at points of contact or, additionally, in response to daylight or darkness. Correspondingly, these characteristics can be made to attach to intruding force after disturbance.

Figure 2:
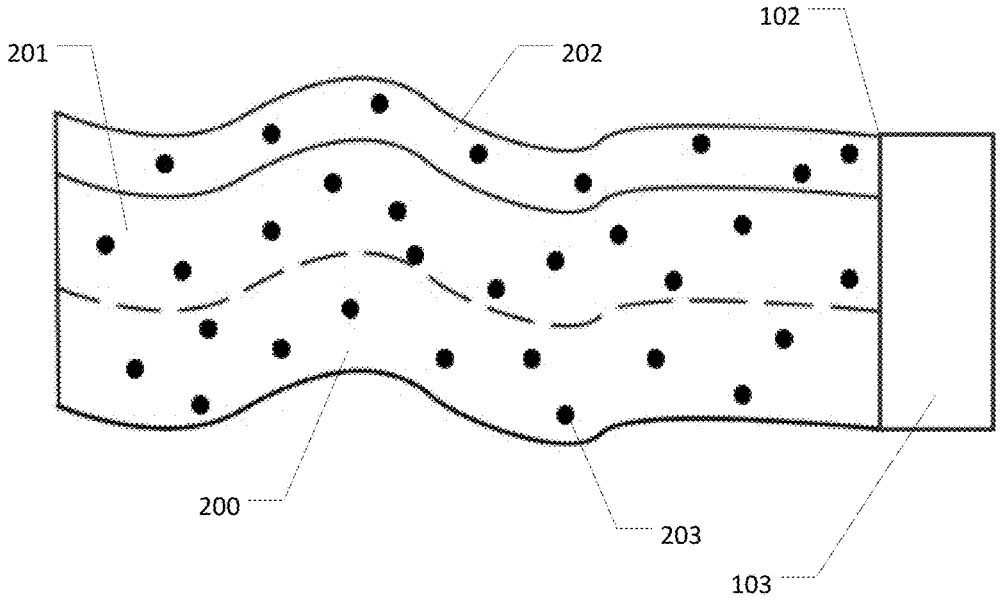
FIG. 2 illustrates an internal close-up view of a chemical upon an undisturbed terrain.

FIG. 2 illustrates an internal close-up view of a chemical upon an undisturbed terrain. Chemical 100, in one embodiment, coats terrain 103 directly. Just as the width of monitored area 101 can be adjusted as needed, the height and thickness of chemical 100 may also be set to user's desired specifications. In one embodiment, chemical 100 can contain one or more layers coated onto the terrain, as additional layers may be added over time. In one embodiment, a working level coating 200 can be applied directly to the terrain. In one embodiment, working level coating 200 can act as a base for a heavier coating layer 201 meant to last longer than working level coating 200.

In one embodiment, a covering layer 202 can coat the top of chemical 100. Covering layer 202 can comprise one or more additional layers of chemical 100. In another embodiment, the covering layer 202 can comprise material similar to adjacent surfaces to camouflage monitored area 102 and visually blend chemical 100 with terrain 103.

To enhance the performance of monitoring area 101, chemical 100 can contain additives 203 comprising a variety of substances for various functional uses, such as, but not limited to, adaptation to various terrains, adhesion enhancement, corrosion resistance and preservation of impressions. For the purposes of this disclosure, the term 'additive' can be a substance added for structural enhancement of chemical 100 and/or application of chemical 100 to terrain or other surface. In one embodiment, additives 203 can be included in layers 200, layer 201 and even covering layer 202. Additives 203 can allow chemical 100 to adjust to the various terrains or even other surfaces, including, but not limited to, walls, windows and fences. In one embodiment, additives 203 can comprise foamers and/or volumizers for appropriate thickness and duration of chemical 100 to terrain 300. In addition, additives 203 may also be applied for the enhancement of staining, marking, tracking and/or monitoring, which will be discussed more thoroughly below.

In another embodiment, chemical 100 can be applied to terrain 103 after the removal of ground cover and vegetation of terrain 103. In one embodiment, the site preparation of chemical 100 can be used in conjunction with unexploded ordinance procedures involving the removal of potential explosives, propellants or hazardous munitions from warzones.

Figure 3A:
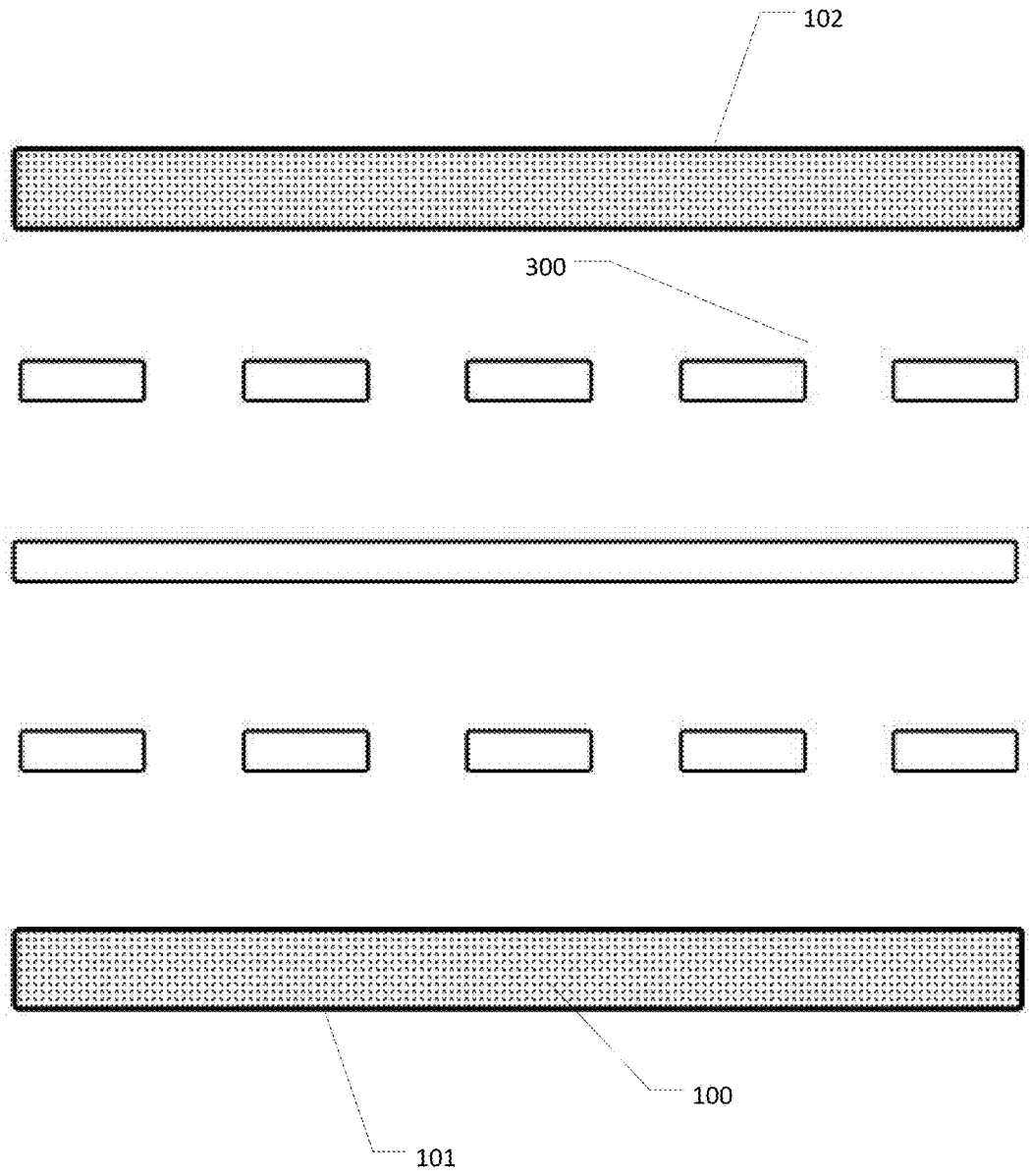
FIG. 3A illustrates a chemical applied to a road.
Figure 3B:
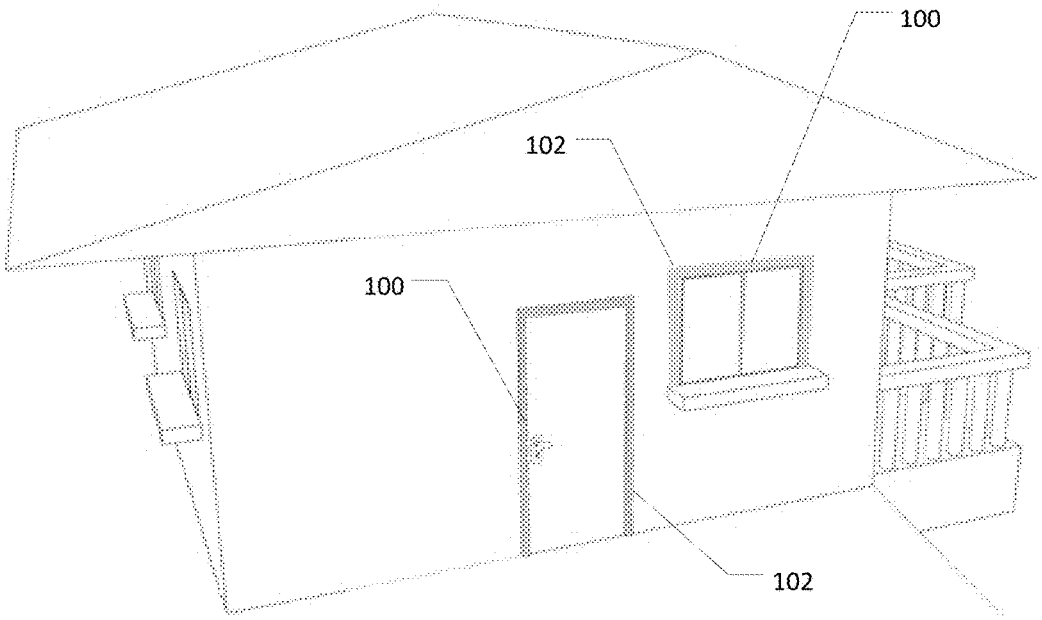
FIG. 3B illustrates a chemical applied to entry points on a building.
Figure 3C:
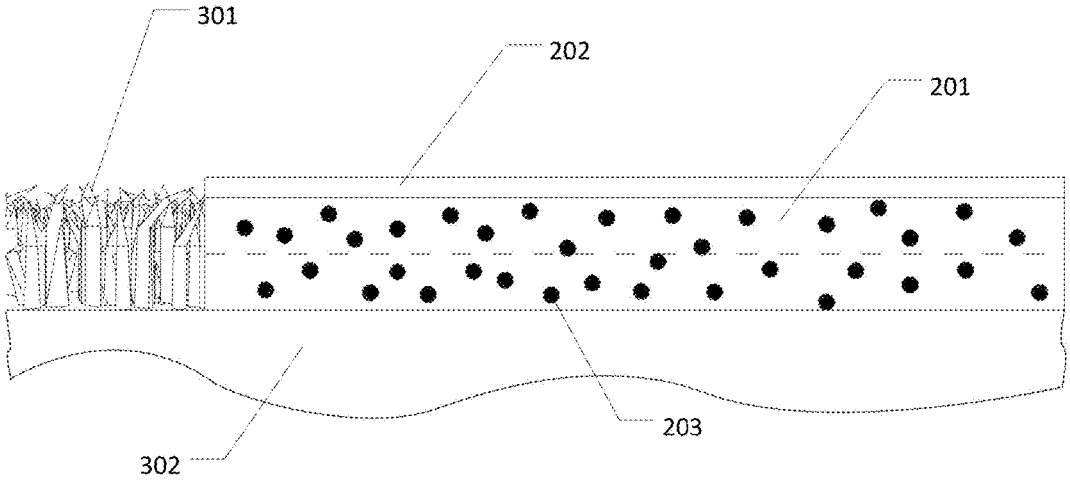
FIG. 3C illustrates a chemical applied to a grass terrain.

FIGS. 3A, 3B and 3C illustrate how chemical 100 can be applied to many different types of surfaces and terrains, including, but not limited to, rural and urban environments. FIG. 3A illustrates chemical 100 applied to a road. In one embodiment, chemical 100 can also be applied to roadside edges of asphalt, concrete, dirt or other material to detect potential IED installations and monitor movements of intruders. Also, chemical 100 can contain asphalt-based additives 203, which may coat surfaces, such as road 300. Particularly, additives 203 can comprise bonders for enhanced adhesion of chemical 100 to any corresponding base substrates of other types of terrain 103 or surface, such as gravel, or dirt, for example. Additives 203 can also comprise adhesives to enhance the bond of chemical 100 to a particular surface. In one embodiment, additives 203 can comprise dusts.

FIG. 3B illustrates a chemical applied to entry points on a building. Aside from terrains, chemical 100 can be applied to other types of surfaces, such as walls. In one embodiment, chemical 100 can have large-scale applications, such as the monitoring of entire building surface, or, in another embodiment, small-scale applications, such as the monitoring of an individual door or window on a building. Application of chemical 100 can monitor attempts to break into potential access points, even when such intrusion is done through covert tactics, such as picking a lock.

FIG. 3C illustrates a chemical applied to a grass terrain. For terrain with grass 301 or other vegetation, additives 203 can comprise herbicides to block growth from the soil under monitored area 101. Herbicides can be applied in between applications of chemical 100. Furthermore, additives 203, chemical 100 and any combination of both can be non-toxic and biodegradable. Chemical 100, in one embodiment, can be applied to a desert area. Sand based additives 203 may be applied to both secure chemical 100 to sand-based terrains and blend it with the desert surface. As a result, sand-based additives 203 can assist in presenting monitored area 101 as undisturbed prior to intrusion. In another embodiment, chemical 100 can comprise sand, a sand-based composite compound, a sand-based mixture or, in general, sand-like properties. For example, natural or synthetic polymers, such as polyvinyl acetate (PVAc), a synthetic, rubber-based polymer may be present as a substrate composition of chemical 100 or as additives 203 combined with chemical 100. In one embodiment, polymerization, which involves the process of forming molecular chains, can be used to either form chemical 100 or form additives 203 to apply to chemical 100. In addition, polyvinyl acetate may also be used as an adhesive for sand-based composite versions of chemical 100 to coat desert terrains. Furthermore, in addition to leaving impressions, sand-based composites of chemical 100 can indicate disturbance, as an intruding force may displace or drag particles throughout the monitored area 101. As a result, particles of chemical 100 can be tracked beyond the boundaries of monitored area 101.

Figure 4A:
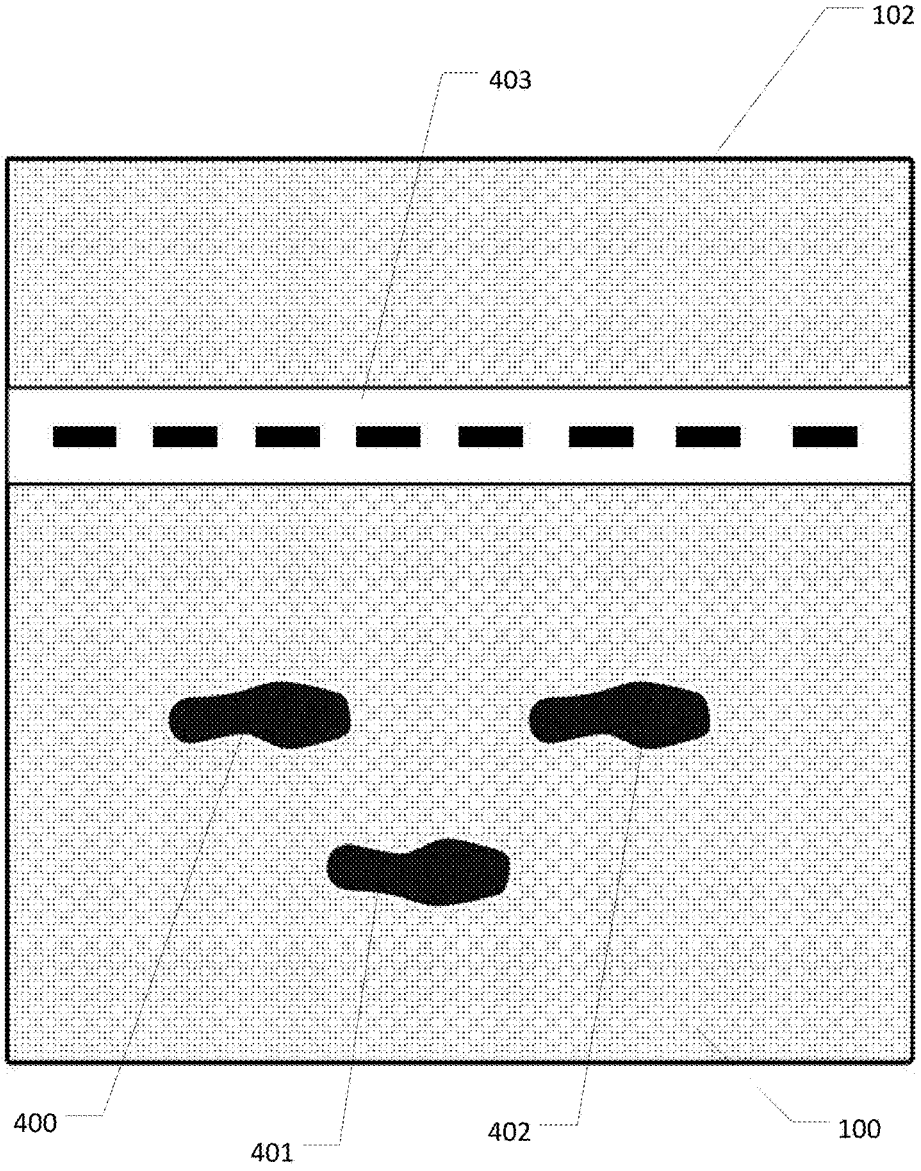
FIG. 4A illustrates an aerial view of a monitored area with disturbances.

FIG. 4A illustrates an aerial view of a monitored area with disturbances. Chemical 100 indicates disturbances to monitored area 101 by the appearance of footprints and tire tread. Chemical 100 produces impressions 400, 401, 402 and 403 created by intruding forces entering the monitored area. In one embodiment impressions 400 through 403 can consist of a permanently flattened chemical 100. As a result, impressions 400, 401, 402 and 403 can be preserved for an indefinite amount of time. In another embodiment, impressions 400, 401, 402 and 403 can be preserved by chemical 100 temporarily or for an adjustable amount of time. The exact size, shape and dimensions of the intruding force's feet from impressions 400, 401, and 402, as well as tire tread from impression 403, can be determined by measuring and noting peculiarities about impressions 400, 401, 402, and 403. As a result, this can lead to the determination of characteristics about height, weight, vehicle, and, ultimately, the identity of intruding forces. Direction of movement of intruding forces and other patterns may be analyzed as well, in conjunction with other types of surveillance and intelligence gathering methods.

Figure 4B:
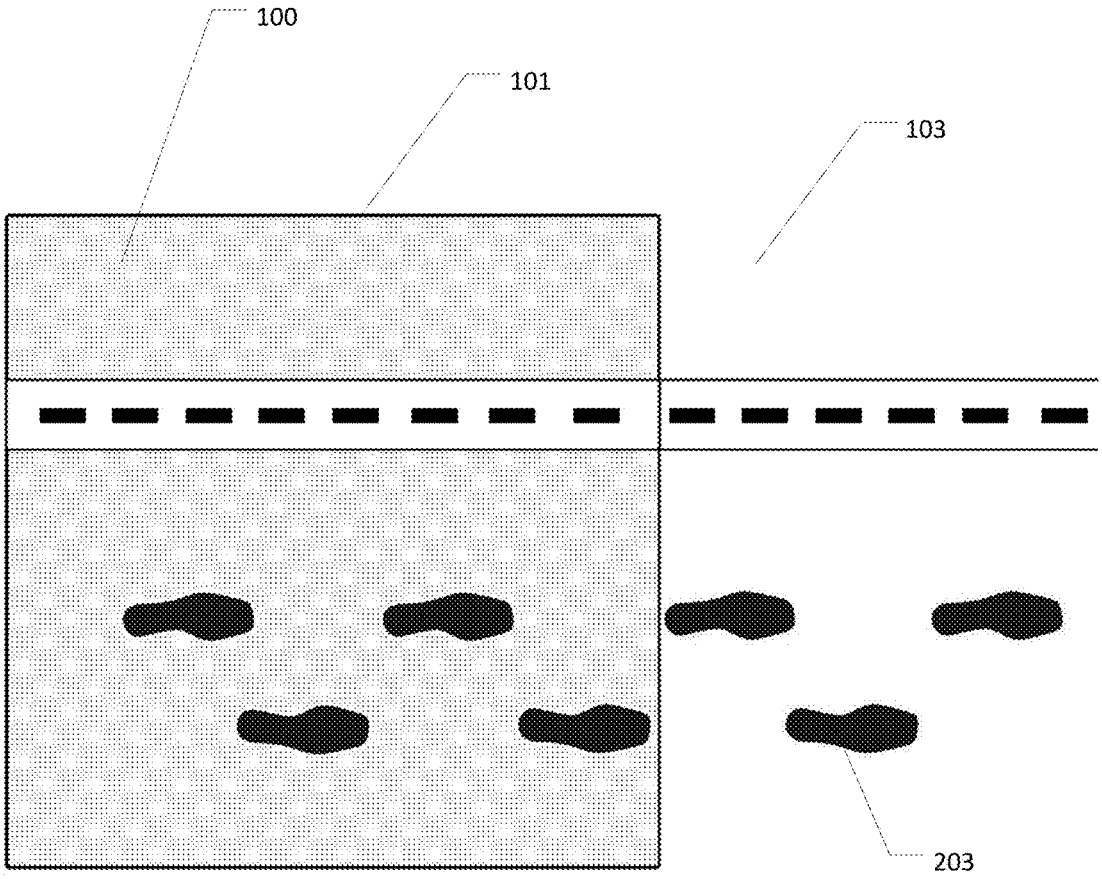
FIG. 4B illustrates how chemical 100 can be tracked beyond a monitored area.

FIG. 4B illustrates how chemical 100 can be tracked beyond monitored area 101. As intruding forces disturb monitored area 101, chemical 100 can attach to, for example, their shoes and/or tires. When intruding forces move beyond monitored area 101, they can leave behind traces of chemical 100 in terrain 103 that continue beyond their original path through the monitored area 101. In one embodiment, additives 203 can allow traces of chemical 100 to be left behind on terrain 103 in the form of footprints and tire tracks even outside of monitored area 101. Thus, intruding forces can be followed to their source.

Figure 5A:
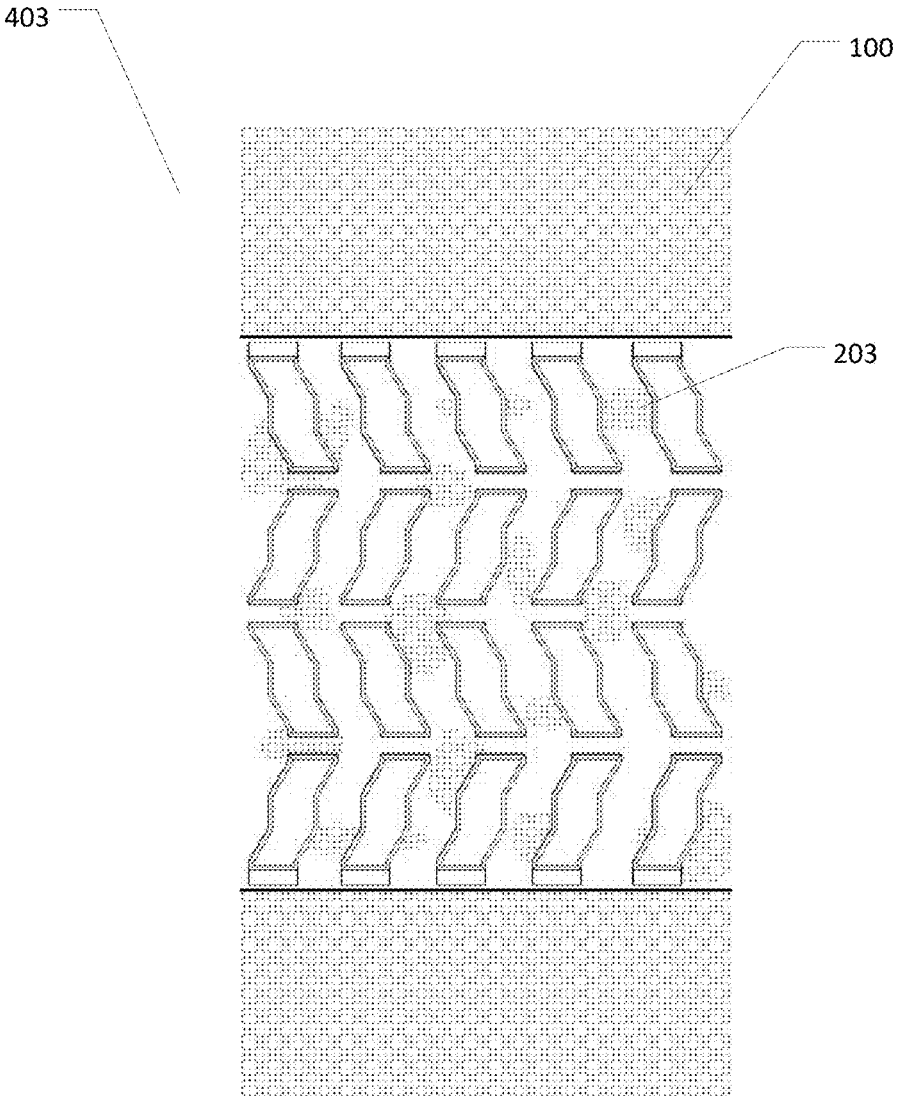
FIG. 5A illustrates an internal close-up view of a tire tread impression.

FIG. 5A illustrates an internal close-up view of a tire tread impression. In one embodiment, additives 203, which are crushed into impressions 400, can aid in preserving characteristics of disturbance and/or producing a replica of the disturbance. In one embodiment, chemical 100 and/or additives 203, can retain a permanent crushed finish after disturbance to seal the surface of footprint impressions 400. As a result, impressions 400 can be preserved and potentially removed for additional analysis. In another embodiment, the additives 203 may act to preserve impressions 400 of objects after contact.

Figure 5B:
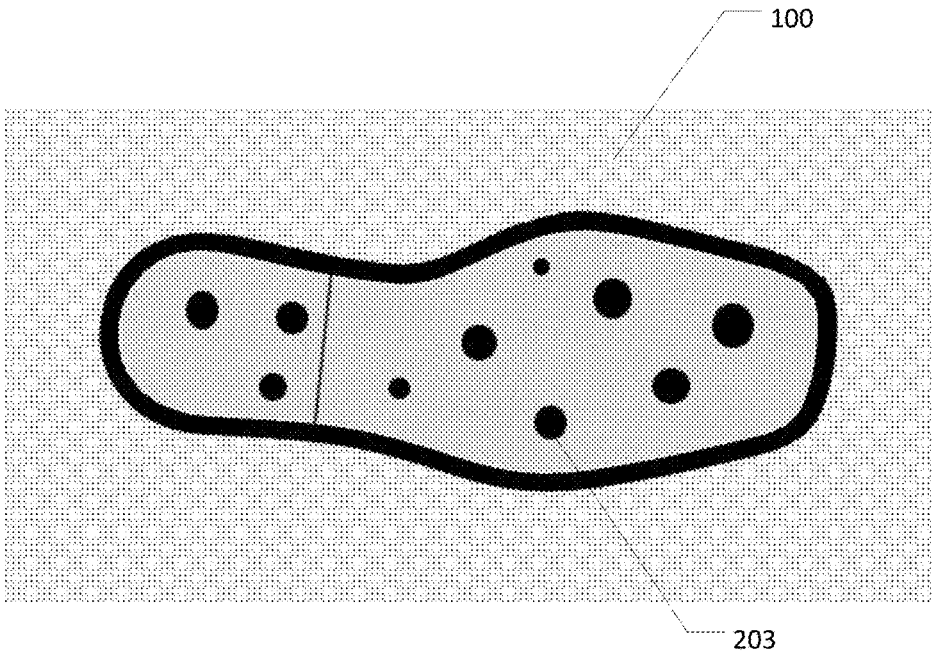
FIG. 5B illustrates an internal close-up view of a footprint impression.

FIG. 5B illustrates an internal close-up view of a footprint impression. In one embodiment, microdot technology can be used as additives 203 to determine characteristics about intruding forces. Microdot technology can include multiple very small, microscopic, identification tags with unique codes or serial numbers. Microdots can be applied by adhesives within chemical 100. Additives 203 can also comprise adhesives. Microdot technology can be utilized in a follow-up investigation to match intruding force to the location of impressions 400, 401, 402 and 403. In one embodiment, microdots in chemical 100 can have a one-time use. In one embodiment, microdot technology can be logged and controlled in conjunction with placement of additives 203 in chemical 100.

Figure 6A:
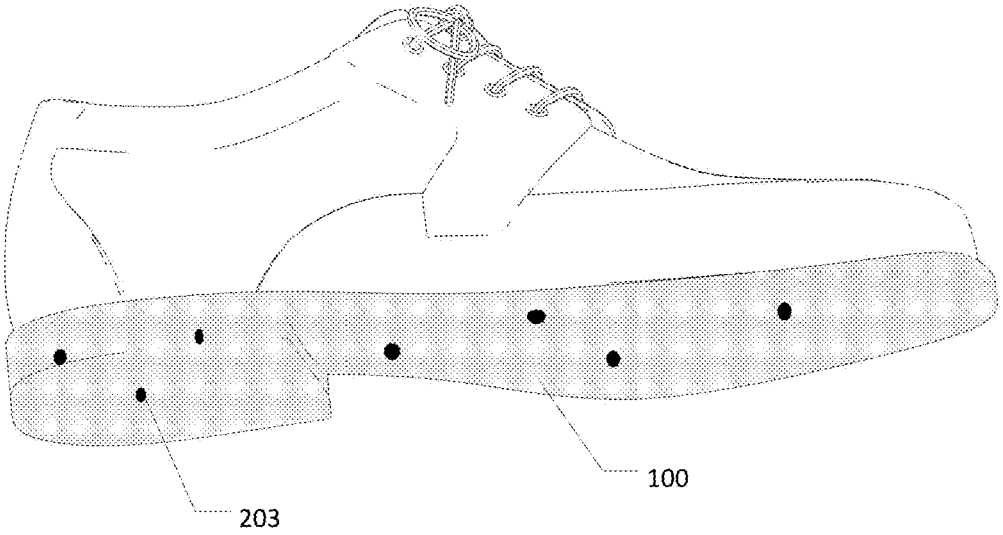
FIG. 6A illustrates a shoe heel stained after disturbing a monitored area.

FIG. 6A illustrates a shoe heel stained after disturbing a monitored area. In addition to indicating disturbances, chemical 100 can stain shoe heel of intruding force walking through monitored area 101. In one embodiment, additives 203 may also leave trace elements onto intruding force upon contact with chemical 100. Aside from allowing for observation and preservation of the dimensions of the impressions 400, 401, 402, and 403, additives 203 can be used for tracking intruding forces by staining them after disturbance occurs in chemical 100.

In one embodiment, chemical 100 can comprise visible traces which cannot be removed. In another embodiment, chemical 100 can be transparent to prevent knowledge of detection. Assuming retrieval of intruding force, the precise nature of the disturbance to surface can be confirmed and matched by comparison with impressions 400, 401, 402 and 403. Any trace elements of chemical 100 or additive 203 on stain of intruding force can confirm source of disturbance.

Figure 6B:
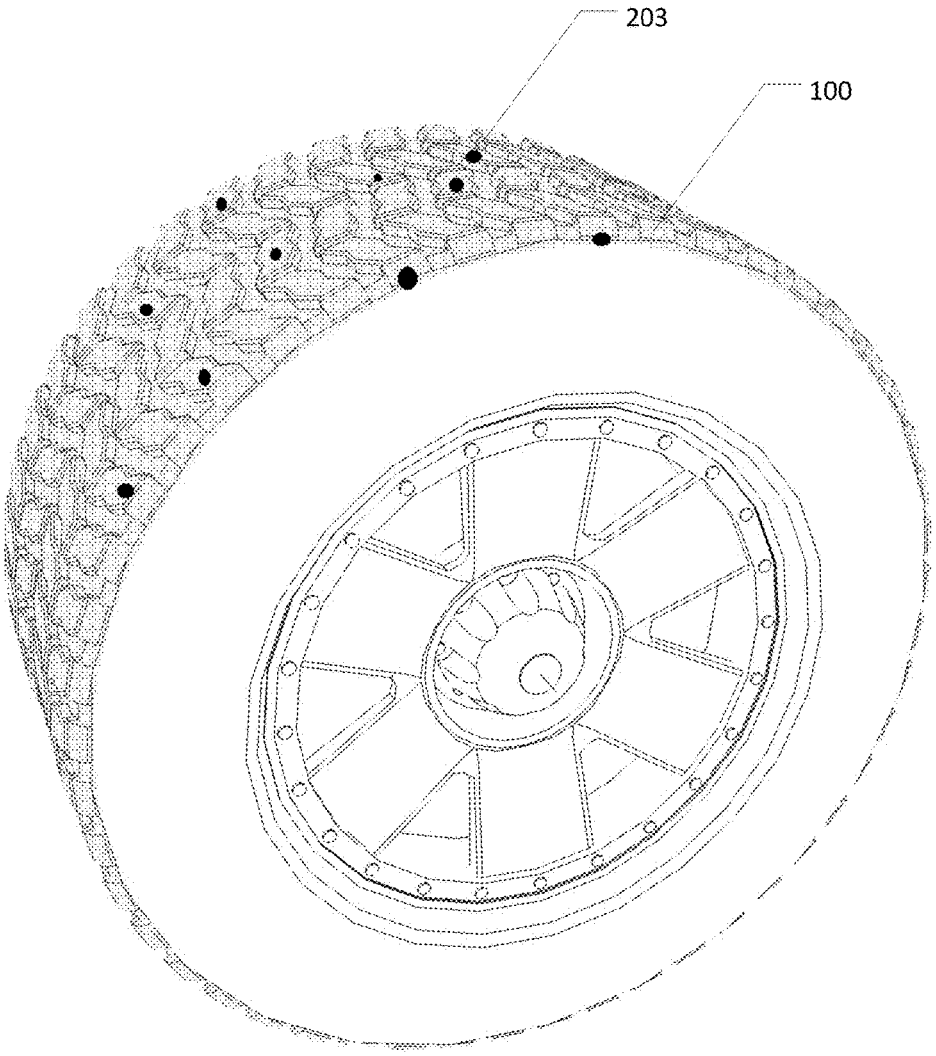
FIG. 6B illustrates a tire stained after disturbing a monitoring area.

FIG. 6B illustrates a tire stained after disturbing a monitored area. Chemical 100 can stain both surface of tread and crevices between tread. Chemical 100 and/or additives 203 can attach firmly between tread crevices, so as to stain tire even after vehicle encounters weather elements, such as rain, and/or general wear and tear. The use of additives 203 can establish timeline and positively identify intruding forces. In one embodiment, additives 203 may indicate a particular time in which the impressions 400 were formed by disturbances by intruding force. In one embodiment, the intruder's tire can be stained by the compound 100 upon contact covertly, so intruder is unaware of detection. Stain on intruding force can be checked against impressions 400, 401, 402, and 403 and used in conjunction with current post-investigation security methods.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A method for monitoring an area comprising, spraying a chemical onto a terrain while said chemical is in a liquid form, said chemical forming a monitored area on said surface, said monitored area capable of being disturbed by contact with an intruding force causing a disturbance on said surface, wherein said chemical comprises an additive, said additive capable of staining said intruding force, further wherein said additive is capable of preserving said disturbance.

2. The method in claim 1, wherein said additive further comprises herbicides, said herbicides preventing growth of vegetation on a terrain.

3. The method in claim 1, wherein said additive comprises dye, said dye enhancing visibility of said disturbances in said chemical.

4. The method in claim 1, wherein said additive further comprises glossers, said glossers enhancing visibility of disturbances in chemical.

5. The method in claim 1, wherein said additive further comprises foamers, said foamers adjusting thickness and durability of chemical applied to surface.

6. The method in claim 1, wherein said additive comprises ultraviolet markers, said ultraviolet markers revealing visibility of disturbances in response to ultraviolet radiation.

7. The method described in claim 1, wherein stained intruding force is capable of being matched to said disturbance on said chemical.

8. The method in claim 1, wherein multiple layers of said chemical can coat a surface.

9. The method in claim 1, wherein said chemical comprises a covering layer.

10. The method in claim 9, wherein said covering layer is composed of one or more additional layers of said chemical.

11. The method in claim 9, wherein said covering layer is composed of material similar to an adjacent surface.

12. The method in claim 1, wherein said chemical comprises a liquid polyvinyl acetate emulsion.

13. The method described in claim 1, wherein said chemical is capable of staining said intruding force upon contact.

14. A method for monitoring an area comprising, spraying a chemical onto a terrain while said chemical is in a liquid form, said chemical forming a monitored area on said surface, said monitored area capable of being disturbed by contact with an intruding force causing a disturbance on said surface, wherein said chemical comprises an additive, said additive capable of staining said intruding force, further wherein said additive comprises microdot technology, said microdot technology comprising a code, said code linkable to said intruding force upon contact.

15. The method in claim 14, wherein said additive further comprises herbicides, said herbicides preventing growth of vegetation on a terrain.

16. The method in claim 14, wherein said additive comprises dye, said dye enhancing visibility of said disturbances in said chemical.

17. The method in claim 14, wherein said additive further comprises glossers, said glossers enhancing visibility of disturbances in chemical.

18. The method in claim 14, wherein said additive further comprises foamers, said foamers adjusting thickness and durability of chemical applied to surface.

19. The method in claim 14, wherein said additive comprises ultraviolet markers, said ultraviolet markers revealing visibility of disturbances in response to ultraviolet radiation.

* * * * *